United States Patent [19]

Rose et al.

[11] Patent Number: 4,724,896

[45] Date of Patent: Feb. 16, 1988

[54] APPARATUS AND METHOD FOR IMPROVING THE SURFACE CHARACTERISTICS OF CONTINUOUSLY CAST METAL INGOT

[75] Inventors: Robert M. Rose, Rockdale, Tex.; Jeffrey J. Wiesner, Washington Township, Armstrong County; Clarence J. Cox, Jr., Hampton Township, Allegheny County, both of Pa.

[73] Assignee: Aluminum Company of America, Pittsburgh, Pa.

[21] Appl. No.: 12,482

[22] Filed: Feb. 9, 1987

[51] Int. Cl.[4] ..... B22D 27/02

[52] U.S. Cl. ..... 164/467; 164/488; 164/437; 164/503

[58] Field of Search ..... 164/467, 503, 437, 488, 164/489, 418, 459

[56] References Cited

U.S. PATENT DOCUMENTS 3,669,181 6/1972 Schrewe ..... 164/437
4,273,180 6/1981 Tertishnikov et al. .

FOREIGN PATENT DOCUMENTS 54-40210 12/1979 Japan .
455794 2/1975 U.S.S.R. .

*Primary Examiner*—Kuang Y. Lin
*Attorney, Agent, or Firm*—Gary P. Topolosky

[57] ABSTRACT

An apparatus for improving the surface characteristics of a continuously cast metal ingot comprises: a skim dam having outer lateral edges which diverge downwardly into an upper molten surface of the ingot during casting in a mold; and means for suspending the skim dam in the upper molten surface. Preferably, the outer lateral edges intersect the upper molten surface at an angle between about 105° and 150°, and more preferably at about a 120° angle. The outer lateral edges maintain an acutely angled meniscus inwardly of the meniscus between the upper molten surface and the side surfaces of the ingot. A method for inhibiting the formation of vertical folds and oxide releases on a metal ingot continuously cast in an electromagnetic mold comprises suspending a skim dam in an upper molten surface of the ingot during casting, said skim dam having outer lateral edges which are not wetted by the upper molten surface and diverge downwardly into same.

35 Claims, 4 Drawing Figures

APPARATUS AND METHOD FOR IMPROVING THE SURFACE CHARACTERISTICS OF CONTINUOUSLY CAST METAL INGOT

BACKGROUND OF THE INVENTION

1. Field of the Invention

This invention relates to the continuous casting of metal ingots. Particularly, the invention relates to the casting of aluminum alloy ingots in an electromagnetic mold. More particularly, the invention relates to an apparatus and method for improving the surface characteristics of an aluminum-magnesium alloy ingot by inhibiting the formation of vertical folds, oxide releases and other surface defects thereon.

2. Description of the Prior Art

It is well known to continuously cast metal or metal alloy ingots. A typical continuous ingot caster comprises a containment or metal trough positioned over a casting mold. The casting mold includes a bottom plate or block positioned in close proximity to a plurality of mold sidewalls joined along adjacent edges. When these sidewalls are exposed to a coolant, the molten metal deposited therebetween solidifies from bottom to top and from side surfaces inwardly. As the metal solidifies, the bottom block is withdrawn from the sidewalls to continuously discharge the ingot out the bottom of the mold.

There are several disadvantages to casting ingots of an aluminum alloy in the above manner. As these ingots solidify, their side surfaces adhere to the mold sidewalls and tear away unevenly. Other surface defects such as laps and inverse segregation also result from ingot contact with the mold sidewalls. Before these ingots may be rolled into various sheet products, the rough side surfaces must be cut smooth or scalped. Scalping is costly, however, in terms of the machinery and manpower required, production time lost and potentially usable metal removed from each ingot.

It is further known to continuously cast metal ingots in a mold which includes an electromagnetic field. More particularly, an electromagnetic casting mold includes a bottom block extending to or between an electromagnetic inducting surface. The molten metal delivered to this mold assumes a shape defined by the inducting surface. Particularly, electromagnetic forces from the inducting surface repel molten metal inwardly until it sufficiently solidifies with exposure to a coolant. Ingots are cast, therefore, without contacting any physical surface other than the mold bottom block. These ingots typically have smooth side surfaces which do not require scalping. They also exhibit a more uniform chemical composition and crystalline structure.

In the electromagnetic continuous casting of some aluminum alloys, the oxides which should deposit as a thin, uniform film on the side ingot surfaces collect on the upper molten surface during casting in the mold. These metal oxides then release over the meniscus between the upper molten surface and side ingot surfaces and deposit as thick bands or thereon. Oxide releases diminish the appearance and value of the ingots on which they form. Hence, such releases are typically removed before rolling or resale by scalping.

For billets or ingots electromagnetically cast in a cylindrical shape, there are fewer problems with oxide releases because oxides tend to shift more smoothly over the nearer meniscus of said ingots and deposit more uniformly thereon. Nevertheless, there is disclosed a shell-like apparatus for inhibiting the formation of uneven oxide layers on such ingots in U.S Pat. No. 4,273,180. This apparatus extends perpendicularly from a mold cover and partially into the upper molten surface to minimize the surface defects caused by electromagnetic turbulences from the mold inducting surfaces. The apparatus further shapes the side surfaces of the ingot and seals the upper molten surface of same in a protective atmosphere of flux or slag.

It is further known to cover the solidification zone of an electromagnetic casting mold in order to maintain an atmosphere of nonreactive gas, such as nitrogen or argon, thereunder. Exemplary of said covers is that disclosed in Russian Patent No. 455,794.

In the electromagnetic continuous casting of substantially rectangularly-shaped ingots, oxide release problems are more prevalent. Although metal oxides should deposit as a thin, uniformly, outer film on said ingots, they tend to gather on the upper molten surface and release irregularly to form thick bands or patches thereon.

To promote a more uniform deposit of oxides on continuously cast aluminum alloy ingots, a floating skim dam or frame was disclosed in Japanese Patent No. 54-40210. A preferred embodiment of the skim frame taught therein resembles a cross section of the ingot cast and consists of two (2) U-shaped sections of insulating material, each section having outer lateral edges which contact with the ingot at an angle between 30° and 60° . Most particularly, the outer lateral edges of said skim dam intersect the upper molten surface at a 45° angle between 0.4–6.0 inches (10–150 mm) inwardly from the side ingot surfaces.

For aluminum-magnesium alloy ingots, the oxide release problem is further complicated by the ease at which magnesium oxide forms. When the foregoing shell-like apparatus or converging skim frame is extended into an upper molten surface of said ingots during casting, overall surface characteristics are not substantially improved. Although these prior art devices often inhibit the formation of oxide releases, they also cause an undesirable amount of grooves or vertical folds to form. Such vertical folds seldom exceed 0.3 inch (7.6 mm) in depth. Because they interfere with efficient rolling of the ingots, however, they must also be removed by scalping.

SUMMARY OF THE INVENTION

It is a principal object of this invention to provide an apparatus and method for improving the surface characteristics of continuously cast metal ingots. It is also a principal object of the invention to overcome the defects and disadvantages of the prior art mentioned above.

It is a further object of the invention to provide an apparatus and method for inhibiting the formation of vertical folds, oxide releases, and other surface defects on metal ingots continuously cast in an electromagnetic mold, thereby eliminating the need to scalp said ingots before rolling.

It is still a further obiect of the invention to provide a skim dam which is less dependent upon its size, outer shape and distance from the side ingot surfaces for inhibiting the formation of vertical folds, oxide releases, and other defects thereon.

In accordance with the above-identified objects of this invention, there is provided an apparatus for improving the surface characteristics of a continuously cast metal ingot, particularly by inhibiting the formation of vertical folds and oxide releases thereon. The apparatus comprises: a skim dam having outer lateral edges which diverge downwardly into an upper molten surface of the ingot during casting in a mold; and means for suspending the skim dam in the upper molten surface. Preferably, the outer lateral edges intersect the upper molten surface at an angle between about 105° and 150°, and more preferably, at about a 120° angle. The outer lateral edges of this invention maintain an acutely angled meniscus inwardly of the meniscus between the upper molten surface and side ingot surfaces.

There is also disclosed a method for inhibiting the formation of vertical folds and oxide releases on metal ingots continuously cast in an electromagnetic mold. The method comprises suspending a skim dam in the upper molten surface of the ingot during casting, said skim dam having outer lateral edges which are not wetted by the upper molten surface and diverge downwardly into the upper molten surface.

DETAILED DESCRIPTION OF THE DRAWINGS

Further features, other objects and advantages of the present invention will become clear from the following detailed description of the preferred embodiments made with reference to the drawings in which.

DETAILED DESCRIPTION OF THE PREFERRED EMBODIMENTS

In the description of the preferred embodiments which follows, reference is repeatedly made to ingots electromagnetically cast from an aluminum-magnesium alloy. Said ingots have side surfaces which are substantially free of vertical folds, oxide releases and other surface defects. It is to be understood, however, that the invention may also be used to cast other metals and metal alloys by other means including Direct Chill (DC) casting.

Figure 1:
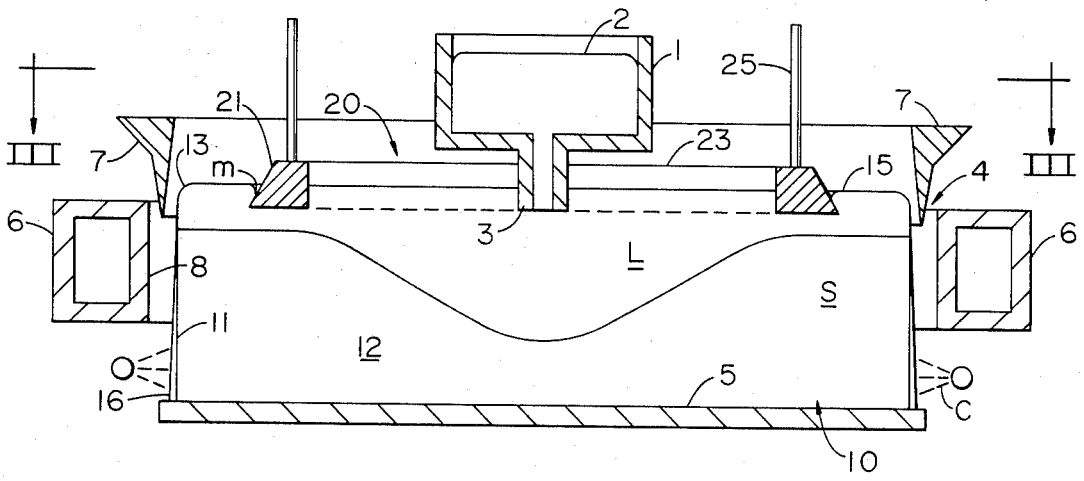
FIG. 1 is a side elevational view, partially in section, of a first embodiment of the invention suspended in a continuously cast metal ingot.
Figure 2:
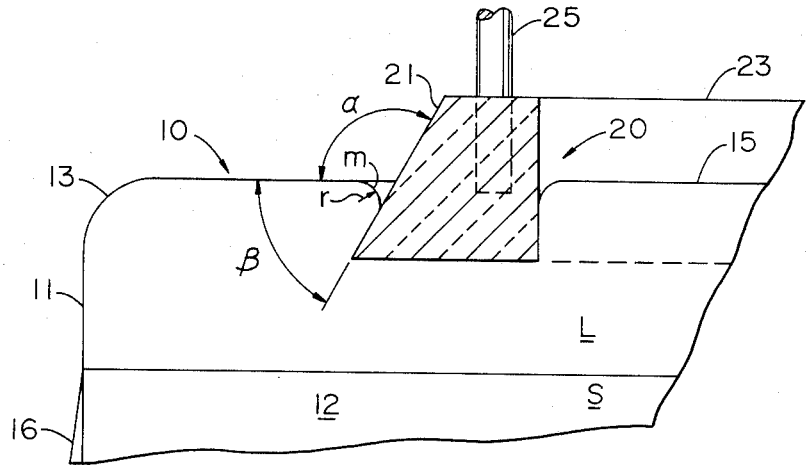
FIG. 2 is an enlarged section of FIG. 1.
Figure 3:
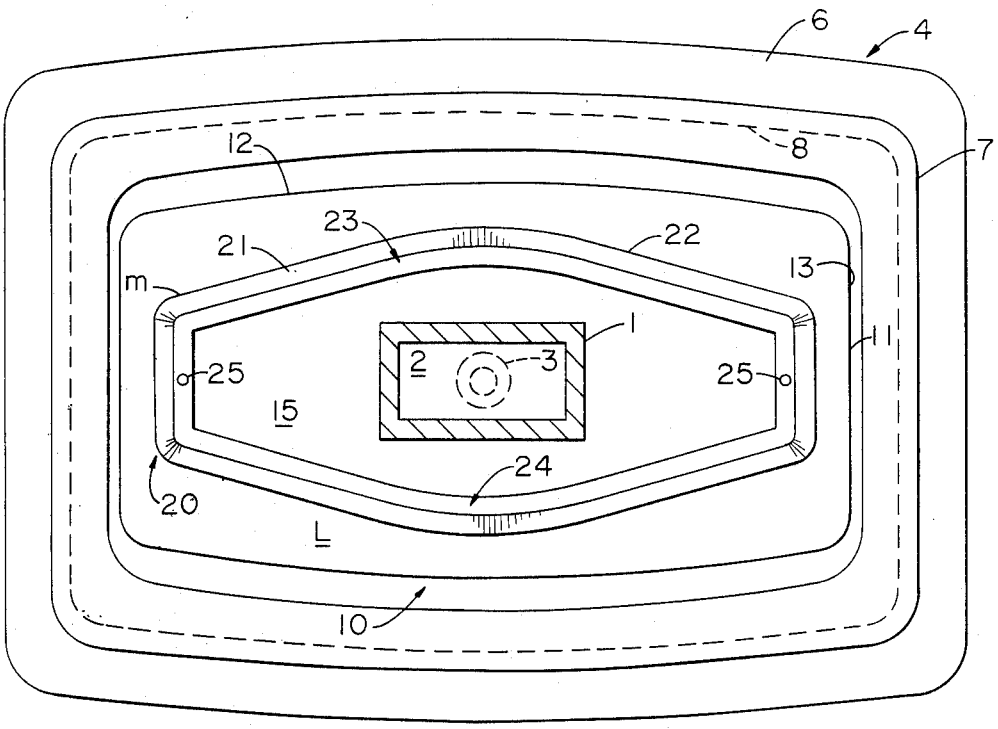
FIG. 3 is a section of FIG. 1 taken along lines III—III.

Referring now to FIGS. 1-3, there is shown a first embodiment of an apparatus for improving the surface characteristics of a continuously cast metal ingot by inhibiting the formation of vertical folds, oxide releases, and other surface defects thereon. The apparatus, as described in greater detail herein, is used with a continuous ingot caster which includes a containment or trough 1 of molten metal 2, such as an aluminum-magnesium alloy. A feeder tube 3 extends downwardly from trough 1 to deliver molten metal 2 into an electromagnetic casting mold, generally 4. The casting mold 4 includes a bottom block 5 which extends to or between an electromagnetic inducting surface 6. A protecting shield 7 extends partially between and above inducting surface 6.

Inducting surface 6 defines a mold interior 8 which determines the overall shape of ingots cast therebetween. For example, an ingot 10 having substantially rectangular cross section is cast from the mold in FIGS. 1-3. Particularly, ingot 10 consists of a top portion, a bottom portion, a pair of opposed end surfaces 11 and a pair of opposed rolling surfaces 12. Ingot 10 further includes a meniscus 13 between the top and side ingot surfaces. When casting ingot 10, molten metal 2 is fed from trough 1 into mold 4, or more particularly, onto bottom block 5 and between inducting surface 6. Thereafter, with continuous exposure of the solid metal to a coolant C, such as sprayed water, ingot 10 solidifies from bottom to top and from the side surfaces inwardly. While it is cast, ingot 10 actually consists of a solid phase S and molten or liquid phase L.

In the continuous casting of most metal ingots, oxides form on the upper molten surface 15 during casting. For electromagnetically cast ingots of an aluminum-magnesium alloy, the most common oxides are either aluminum oxides, magnesium oxides, or both. These oxides should slide over the meniscus 13 and deposit as a thin outer film 16 on the side ingot surfaces. Ideally, outer film 16 should deposit uniformly over end surfaces 11 and rolling surfaces 12 of ingot 10. In actual casting, however, these oxides unpredictably collect on upper molten surface 15 and release irregularly as thick bands or patches. Such oxide releases diminish the appearance and resale value of the ingots on which they appear. Hence, their formation should be controlled, if not completely eliminated.

When outer film 16 deposits irregularly on the side surfaces of ingot 10, other undesirable surface defects also develop. Particularly, a plurality of grooves or vertical folds form across the vertical lengths of end surfaces 11 and rolling surfaces 12. Although these folds seldom exceed 0.3 inch (7.62 mm) in depth, they interfere with efficient rolling of the ingot and must be removed by scalping.

According to the present invention, it was observed that the amount of vertical folds which form on ingot 10 is directly related to the manner in which outer film 16 deposits thereon. More particularly, it is believed that vertical folds form when solid crystals in the molten ingot interior nucleate, grow and rigidly attach themselves to a section of the outer oxide film. These crystals are irregularly pulled with the oxide film over the ingot meniscus, to the side ingot surfaces and into the electromagnetic field. There, electromagnetic forces from inducting surface 6 repel the crystals and outer film into the side ingot surfaces to form a small groove or fold. The fold then propagates along the vertical length of the side ingot surface as outer film 16 stretches with further molten metal solidification.

The apparatus of the present invention comprises: a skim dam 20 having outer lateral edges 21 which diverge downwardly into upper molten surface 15 during casting in a mold; and means for suspending the skim dam in upper molten surface 15. The apparatus is especially used to continuously cast metal ingots in a mold which includes an electromagnetic field. Such ingots have side surfaces which are substantially free of vertical folds, oxide releases and other surface defects.

In the preferred embodiments of this invention, outer lateral edges 21 of skim dam 20 intersect upper molten surface 15 at an angle greater than 90° and less than 180°, particularly at an angle between about 105° and 150°, and more particularly at about a 120° angle, as indicated by angle $\alpha$ in FIG. 2. Because outer lateral edges 21 intersect the liquid phase L of ingot 10 at an obtuse angle, skim dam 20 maintains an acutely angled meniscus m inwardly of the meniscus between upper molten surface 15 and side ingot surfaces. More particularly, outer lateral edges 21 maintain a 60° angled meniscus m (as indicated by angle $\alpha$ in FIG. 2) inwardly of meniscus 13. The meniscus m maintained by skim dam 20 has a smaller radius than the radius of meniscus 13. More particularly, radius r of meniscus m measures about 0.25 inch (6.35 mm) when skim dam 20 is suspended between about 0.75–1.25 inches (19–32 mm) into upper molten surface 15.

In the prior art mentioned above, there are disclosed shell-like apparatus and skim frames for intersecting the upper molten surface of electromagnetically cast metal ingots. Particularly, the shell-like apparatus of U.S. Pat. No. 4,273,180 intersects the ingot surface at a 90° angle while the skim frame of Japanese Patent No. 54-40210 intersects same at a preferred 45° angle. The metal menisci formed by these devices have larger radii than those specified by the present invention. Therefore, the prior art devices do not effectively inhibit the formation of both oxide releases and vertical folds on continuously cast ingots. When acutely angled meniscus m is maintained by skim dam 20 according to the invention, upper molten surface 15 bends back onto itself. Such bending places greater stress on the outer film which forms outside the skim dam. Because of this added stress, outer film 16 fractures more readily, resulting in fewer areas for crystals to rigidly attach and, ultimately, fewer oxide releases and vertical folds formed.

Preferably, skim dam 20 is made from an insulating refractory material which is not wetted by the liquid metal cast. More particularly, skim dam 20 is cut from 2-inch (51 mm) thick sheets of material sold commercially by Johns Manville Company as Marinite® C board. Alternatively, skim dam 20 may be made from materials wetted by molten aluminum or the like, provided that at least the outer lateral edges of said dam are coated with a nonwetting compound. In the preferred embodiments of this invention, the skim dams are cut from single sheets of Marinite® C board. Alternatively, skim dams may be made from a plurality of sheet sections, spaced closely together to reduce their susceptibility to warping and increase longevity. Single-unit and multiple-section skim dams may both be used repeatedly, provided they are occasionally cleaned between castings.

In a first embodiment of the invention shown in FIGS. 1–3, skim dam 20 is annularly shaped and accommodates feeder tube 3 therebetween. Particularly, the perimeter of skim dam 20 is shaped to correspond to the interior of mold 4. More particularly, perimeter 22 has a substantially rectangular shape and includes at least one pair of opposed, outwardly curving sides 23, 24. The outward curvature of the mold interior 8 compensates for the shrinkage of ingot 10 which occurs both during and after solidification.

Figure 4:
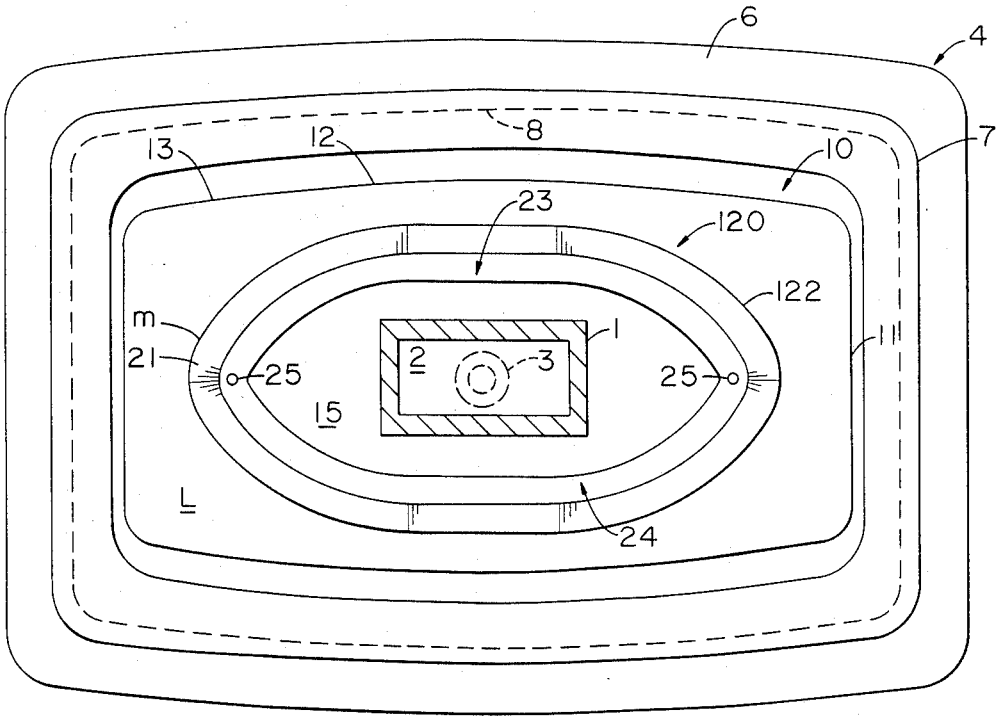
FIG. 4 is a plan view of a second embodiment of the invention suspended in a metal ingot.

In a second embodiment of the invention (FIG. 4), skim dam 120 has a substantially elliptical perimeter 122. It is to be understood, however, that the skim dam perimeters of this invention may assume various other shapes. The overall shape of the skim dam perimeter is not a significant aspect of this invention. Nor is the precise distance of the skim dam from each side surface controlling. Rather, it is the angle at which the skim dam's outer lateral edges intersect the upper molten surface which determines how effectively the invention improves the surface characteristics of continuously cast metal ingots.

In the preferred embodiments of this invention, the skim dams are suspended in upper molten surface 15 by a plurality of support rods 25. These support rods may be fixed or movable in various directions. Preferably, support rods 25 allow for at least vertical movement of the skim dam within mold 4. The number, shape and position of the support rods are not essential to this invention, however.

The invention further discloses a method for improving the surface characteristics of continuously cast metal ingots by inhibiting the formation of vertical folds and oxide releases on the side ingot surfaces during casting in a mold. Particularly, the method comprises maintaining an acutely angled meniscus in an upper molten surface of the ingot inwardly of the meniscus between the upper molten surface and side surfaces of the ingot. Preferably, the acutely angled meniscus is maintained by suspending a skim dam in the upper molten surface, said skim dam having outer lateral edges which intersect the upper molten surface at an angle greater than 90° and less than 180°.

There is further disclosed a method for inhibiting the formation of vertical folds and oxide releases on a metal ingot continuously cast in an electromagnetic mold. The method comprises suspending a skim dam in an upper molten surface of the ingot during casting, said skim dam having outer lateral edges which are not wetted by the upper molten surface and diverge downwardly into same.

Having described the presently preferred embodiments, it is to be understood that the invention may be otherwise embodied within the scope of the appended claims.

What is claimed is:

1. An apparatus for improving the surface characteristics of a metal ingot continuously cast in an electromagnetic mold comprises:

a skim dam having outer lateral edges which each diverge downwardly into an upper molten surface of the ingot during casting in a mold; and means for suspending the skim dam in the upper molten surface.

2. The apparatus of claim 1 wherein the ingot has side surfaces substantially free of vertical folds and oxide releases.

3. The apparatus of claim 2 wherein the outer lateral edges are not wetted by the upper molten surface.

4. The apparatus of claim 3 wherein the outer lateral edges intersect the upper molten surface at an angle between about 105° and 150°.

5. The apparatus of claim 4 wherein the outer lateral edges intersect the upper molten surface at about a 120° angle.

6. The apparatus of claim 1 wherein the skim dam has a perimeter shaped to correspond to an interior of the mold.

7. The apparatus of claim 6 wherein the perimeter includes at least one pair of opposed, outwardly curving sides.

8. The apparatus of claim 1 wherein the skim dam has a substantially elliptical perimeter.

9. The apparatus of claim 1 wherein the ingot is cast from an aluminum-magnesium alloy.

10. An apparatus for improving the surface characteristics of a metal ingot continuously cast in an electromagnetic mold by inhibiting the formation of vertical folds and oxide releases on the side surfaces of the ingot, said apparatus comprising:

a skim dam having outer lateral edges which intersect an upper molten surface of the ingot during casting to maintain an acutely angled meniscus inwardly of a meniscus between the upper molten surface and the side surfaces of the ingot; and means for suspending the skim dam in the upper molten surface.

11. The apparatus of claim 10 wherein the outer lateral edges are not wetted by the upper molten surface.

12. The apparatus of claim 10 wherein the acutely angled meniscus has a radius smaller than a radius of the meniscus between the upper molten surface and the side surfaces.

13. The apparatus of claim 12 wherein the outer lateral edges intersect the upper molten surface at an angle greater than 90° and less than 180°.

14. The apparatus of claim 13 wherein the outer lateral edges intersect the upper molten surface at an angle between about 105° and 150°.

15. The apparatus of claim 14 wherein the outer lateral edges intersect the upper molten surface at about a 120° angle.

16. The apparatus of claim 10 wherein the skim dam has a perimeter shaped to correspond to an interior of the mold.

17. The apparatus of claim 16 wherein the perimeter includes at least one pair of opposed, outwardly curving sides.

18. The apparatus of claim 10 wherein the skim dam has a substantially elliptical perimeter.

19. The apparatus of claim 10 wherein the ingot is cast from an aluminum-magnesium alloy.

20. A method for improving the surface characteristics of a metal ingot continuously cast in an electromagnetic mold by inhibiting the formation of vertical folds and oxide releases on the side surfaces of the ingot during casting in a mold, said method comprising:

maintaining an acutely angled meniscus in an upper molten surface of the ingot inwardly of a meniscus between the upper molten surface and the side surfaces of the ingot.

21. The method of claim 20 wherein the acutely angled meniscus has a radius smaller than the radius of a meniscus between the upper molten surface and the side surfaces.

22. The method of claim 20 wherein the meniscus maintaining step comprises:

suspending a skim dam in the upper molten surface of the ingot, said skim dam having outer lateral edges which intersect the upper molten surface at an angle greater than 90° and less than 180°.

23. The method of claim 22 wherein the outer lateral edges intersect the upper molten surface at an angle between about 105° and 150°.

24. The method of claim 23 wherein the outer lateral edges intersect the upper molten surface at about a 120° angle.

25. The method of claim 22 wherein the skim dam has a perimeter shaped to correspond to an interior of the mold.

26. The method of claim 25 wherein the perimeter includes at least one pair of opposed, outwardly curving sides.

27. The method of claim 22 wherein the skim dam has a substantially elliptical perimeter.

28. The method of claim 20 wherein the ingot is cast from an aluminum-magnesium alloy.

29. A method for inhibiting the formation of vertical folds and oxide releases on a metal ingot continuously cast in an electromagnetic mold, said method comprising:

suspending a skim dam in an upper molten surface of the ingot during casting, said skim dam having outer lateral edges which are not wetted by the upper molten surface and diverge downwardly into the upper molten surface.

30. The method of claim 29 wherein the outer lateral edges intersect the upper molten surface at an angle between about 105° and 150°.

31. The method of claim 30 wherein the outer lateral edges intersect the upper molten surface at about a 120° angle.

32. The method of claim 29 wherein the skim dam has a perimeter shaped to correspond to an interior of the mold.

33. The method of claim 32 wherein the perimeter includes at least one pair of opposed, outwardly curving sides.

34. The method of claim 29 wherein the skim dam has a substantially elliptical perimeter.

35. The method of claim 30 wherein the ingot is cast from an aluminum-magnesium alloy.

* * * * *